US009049978B1

(12) United States Patent
Shamberger

(10) Patent No.: US 9,049,978 B1
(45) Date of Patent: Jun. 9, 2015

(54) SHOE CLEANING APPARATUS

(71) Applicant: Baruch L. Shamberger, Aberdeen, NC (US)

(72) Inventor: Baruch L. Shamberger, Aberdeen, NC (US)

( * ) Notice: Subject to any disclaimer, the term of this patent is extended or adjusted under 35 U.S.C. 154(b) by 0 days.

(21) Appl. No.: 14/096,494

(22) Filed: Dec. 4, 2013

Related U.S. Application Data

(60) Provisional application No. 61/750,060, filed on Jan. 8, 2013.

(51) Int. Cl.
*A47L 23/02* (2006.01)
*A47L 23/26* (2006.01)

(52) U.S. Cl.
CPC ..... *A47L 23/263* (2013.01)

(58) Field of Classification Search
CPC ..... A47L 23/02; A47L 23/263
USPC ..... 15/30–36, 112, 161, 21.1
See application file for complete search history.

(56) References Cited

U.S. PATENT DOCUMENTS

| | | | | |
|---|---|---|---|---|
| 3,729,761 | A * | 5/1973 | Lashley | 15/31 |
| 3,737,942 | A * | 6/1973 | Casey | 15/339 |
| 3,831,217 | A * | 8/1974 | Odawara | 15/34 |
| 3,849,822 | A | 11/1974 | Ouellette | |
| 4,724,564 | A | 2/1988 | Fresh | |
| 5,025,528 | A | 6/1991 | Burey et al. | |
| D338,023 | S | 8/1993 | Usher | |
| D338,751 | S | 8/1993 | Huff | |
| 5,680,666 | A | 10/1997 | Ra | |
| 5,839,144 | A | 11/1998 | Willner | |
| 5,950,269 | A | 9/1999 | Openshaw | |
| 2008/0289127 | A1 | 11/2008 | Guy et al. | |

* cited by examiner

*Primary Examiner* — Shay Karls

(57) ABSTRACT

A shoe cleaning apparatus includes a housing that has a top wall, a bottom wall and a perimeter wall attached to and extending between the top and bottom walls. A cleaning assembly is mounted to the housing and extends upwardly from the top wall. The cleaning assembly cleans a shoe positioned on the top wall. A drive assembly is mechanically coupled to the foot cleaning assembly and rotates a plurality of brushes of the foot assembly when the drive assembly is turned on. A vacuum is mounted within the housing and is in fluid communication with apertures extending through the top wall. The vacuum suctions material from the shoe into the housing.

5 Claims, 4 Drawing Sheets

SHOE CLEANING APPARATUS

I hereby claim the benefit of I hereby claim the benefit under 35 U.S.C. Section 119(e) of U.S. Provisional application No. 61/750,060 filed Jan. 8, 2013.

BACKGROUND OF THE DISCLOSURE

Field of the Disclosure

The disclosure relates to shoe cleaning devices and more particularly pertains to a new shoe cleaning device for cleaning the bottom of soles as well as the perimeter edges of the soles of shoes and which may further clean the perimeter walls of a shoe.

SUMMARY OF THE DISCLOSURE

An embodiment of the disclosure meets the needs presented above by generally comprising a housing that has a top wall, a bottom wall and a perimeter wall attached to and extending between the top and bottom walls. A foot cleaning assembly is mounted to the housing and extends upwardly from the top wall. The foot cleaning assembly includes a plurality of brushes mounted in the top wall. The plurality of brushes each includes an axle and plurality of bristles extending outwardly from an associated one of the axles. Each of the brushes is rotatably coupled to the housing. The plurality of brushes is positioned in a pattern of a foot on the top wall. The plurality of brushes includes a subset of interior brushes and a subset of perimeter brushes disposed around the interior brushes. Each of the interior brushes has its axle being horizontally oriented and rotatable on a horizontal axis. Each of the exterior brushes has its axle being vertically oriented and rotatable on a vertical axis. The exterior brushes are configured to clean an outer perimeter of a shoe while the interior brushes are cleaning a bottom of the shoe. A drive assembly is mechanically coupled to the foot cleaning assembly and rotates the plurality of brushes when the drive assembly is turned on.

An embodiment of the disclosure further meets the needs presented above by generally comprising a housing that has a top wall, a bottom wall and a perimeter wall attached to and extending between the top and bottom walls. A cleaning assembly is mounted to the housing and extends upwardly from the top wall. The cleaning assembly is configured to clean a shoe positioned on the top wall. A drive assembly is mechanically coupled to the foot cleaning assembly and rotates a plurality of brushes of the foot assembly when the drive assembly is turned on. A vacuum is mounted within the housing and is in fluid communication with apertures extending through the top wall. The vacuum is configured to suction material from the shoe into the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
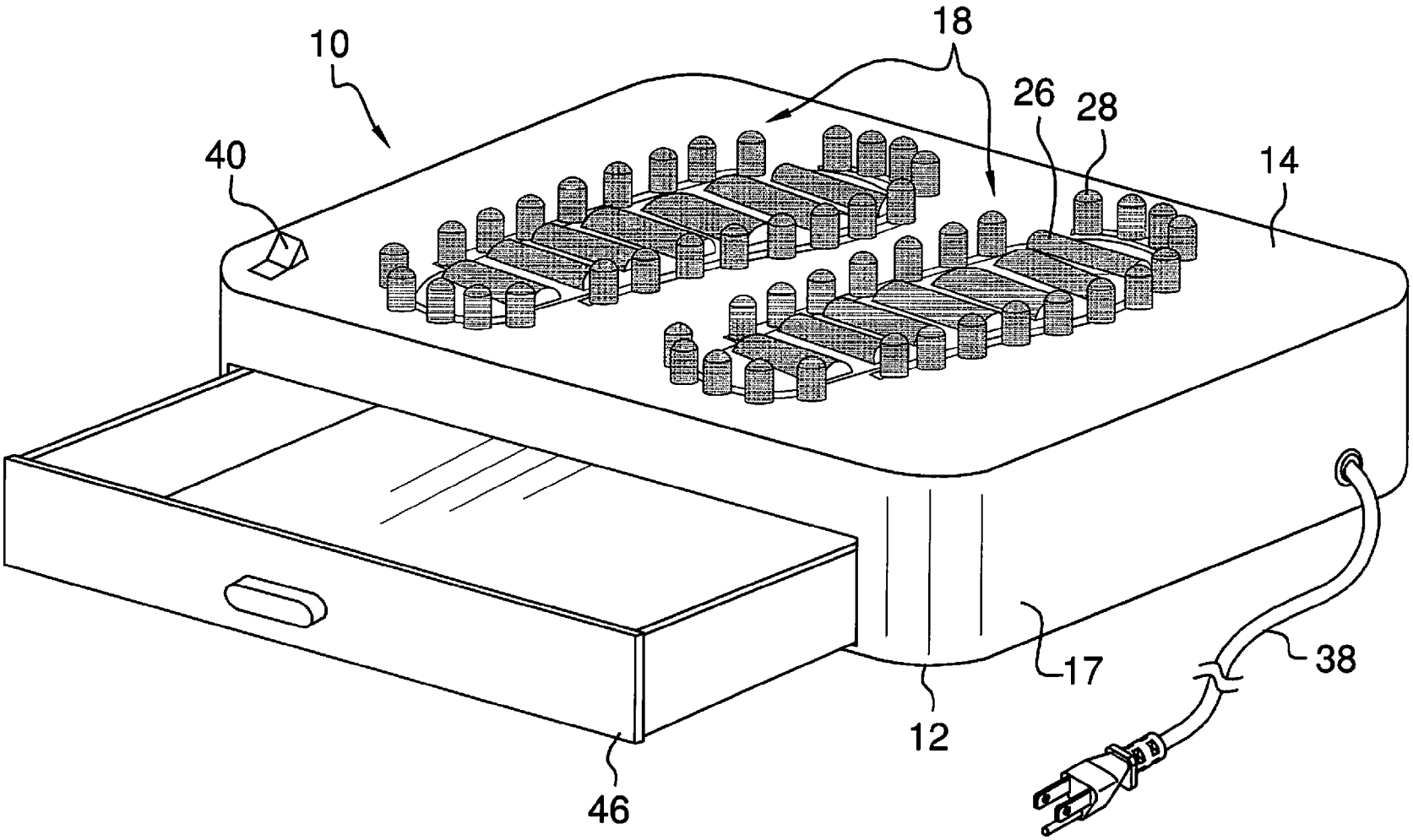
FIG. 1 is a front perspective view of a shoe cleaning apparatus according to an embodiment of the disclosure.
Figure 2:
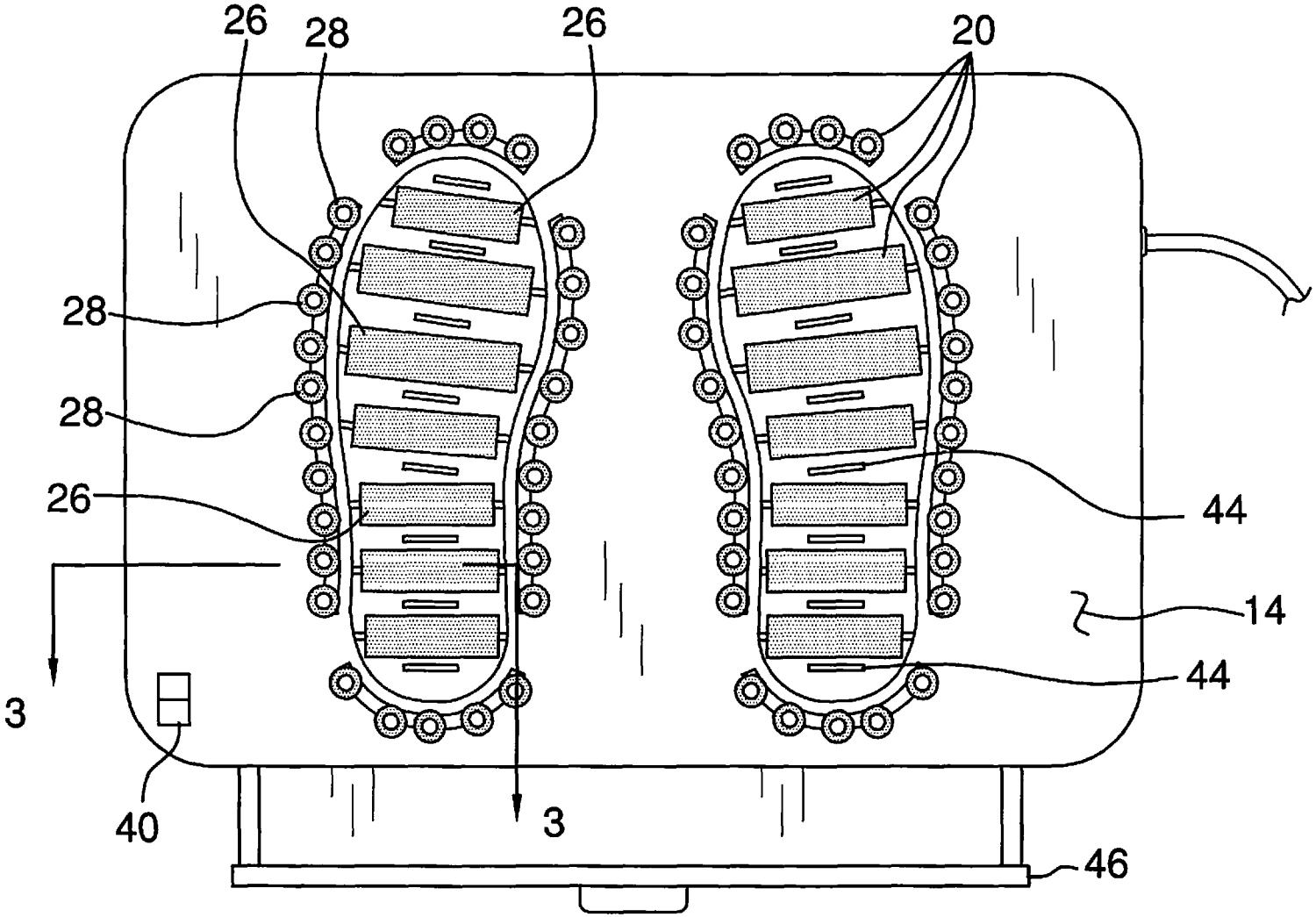
FIG. 2 is a top view of an embodiment of the disclosure.
Figure 3:
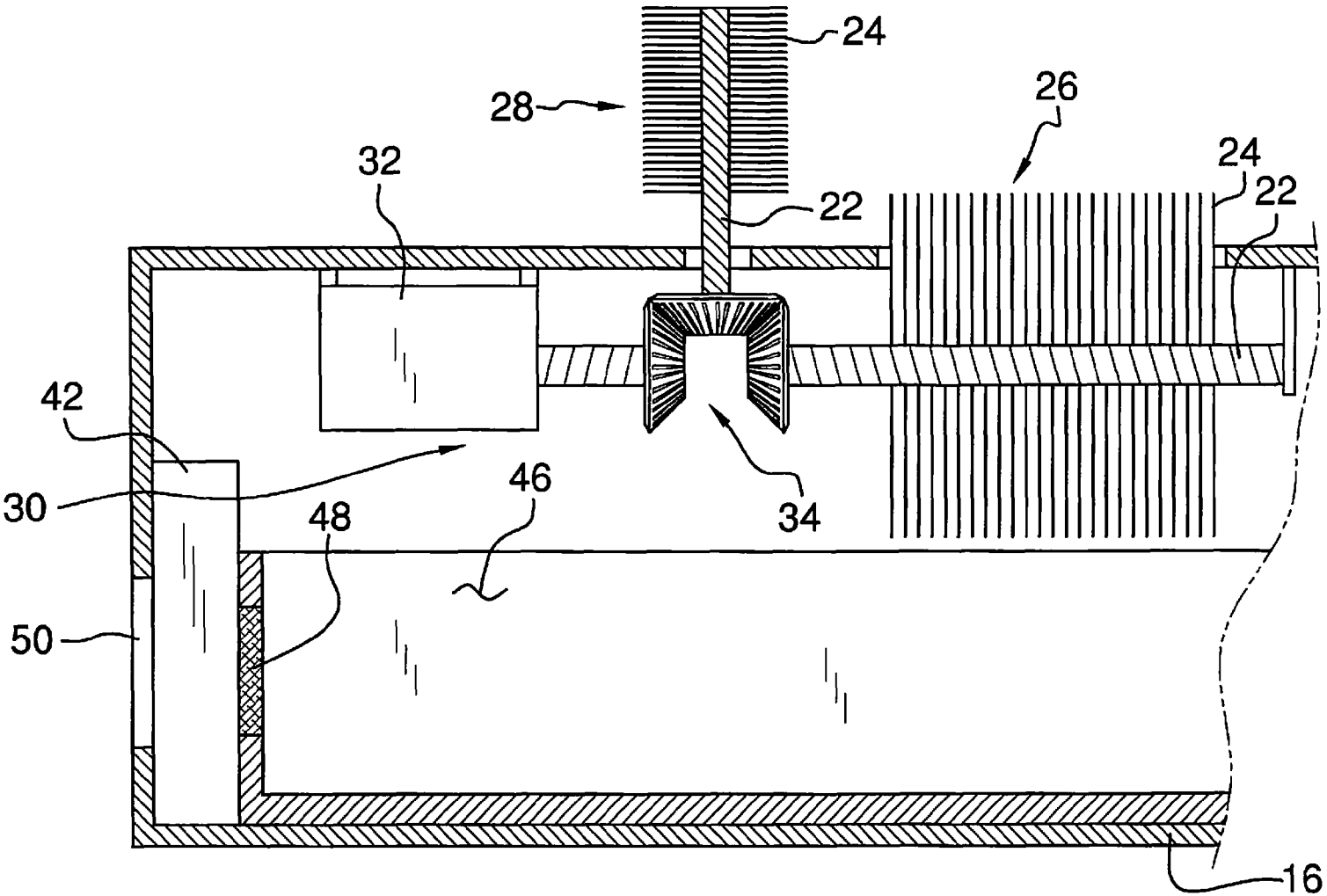
FIG. 3 is a broken cross-sectional view of an embodiment of the disclosure taken along line 3-3 of FIG. 1.
Figure 4:
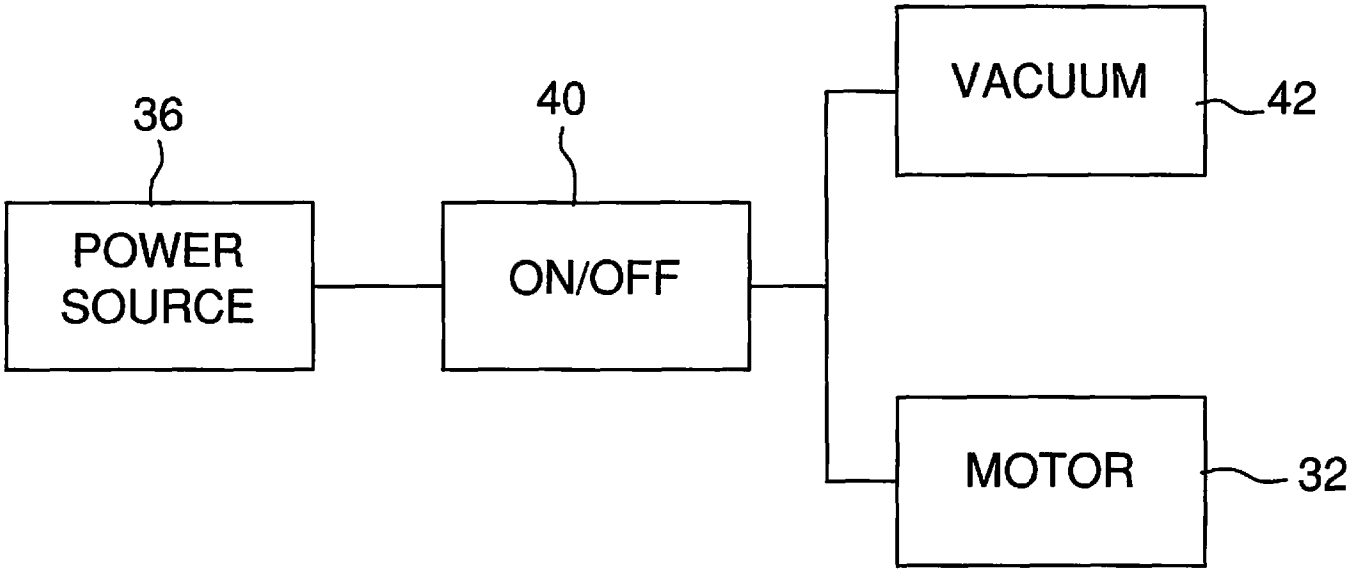
FIG. 4 is a schematic view of an embodiment of the disclosure.

With reference now to the drawings, and in particular to FIGS. 1 through 4 thereof, a new shoe cleaning device embodying the principles and concepts of an embodiment of the disclosure and generally designated by the reference numeral 10 will be described.

As best illustrated in FIGS. 1 through 4, the shoe cleaning apparatus 10 generally comprises a housing 12 that has a top wall 14, a bottom wall 16 and a perimeter wall 17 attached to and extending between the top 14 and bottom 16 walls. The housing 12 will generally be comprised of a rigid material such as a plastic or metallic material though other rigid materials may be utilized. The housing 12 will typically have a length and with each between 12.0 inches and 24.0 inches and a height less than 12.0 inches.

A pair of foot cleaning assemblies 18 is provided. Each of the foot assemblies 18 is mounted to the housing 12 and extends upwardly from the top wall 14. The foot cleaning assemblies 18 each include a plurality of brushes 20 mounted in the top wall 14. The plurality of brushes 20 each includes an axle 22 and plurality of bristles 24 extending outwardly from an associated one of the axles 22. Each of the brushes 20 is rotatably coupled to the housing 12 and each of the plurality of brushes 20 is positioned in a pattern of a foot on the top wall 14. The plurality of brushes 20 includes a subset of interior brushes 26 and a subset of perimeter brushes 28 disposed around the interior brushes 26. Each of the interior brushes 26 has the axle 22 being horizontally oriented and being rotatable on a horizontal axis. Each of the exterior brushes 28 has the axle 22 vertically oriented and being rotatable on a vertical axis. Generally, the bristles 24 on the interior brushes 26 are vertically oriented while the bristles 24 on the perimeter brushes 28 are horizontally oriented. The perimeter brushes 28 are configured to clean an outer perimeter of a shoe while the interior brushes 26 clean a bottom of the shoe. One of the foot cleaning assemblies 18 may have the plurality of brushes 20 positioned in a pattern of a right footed shoe while another of the foot cleaning assemblies 18 may have the plurality of brushes 20 positioned in a pattern of a left footed shoe. However, each may be generally shaped as a shoe having neither left or right characteristics.

A drive assembly 30 is mechanically coupled to each of the foot cleaning assemblies 18 and rotates the plurality of brushes 20 when the drive assembly 30 is turned on. This may be accomplished in any conventional manner such as, for example, by an electric motor 32 being coupled to each of the axles 20 by gears 34 such that each of the axles 22 rotates when the electric motor 32 is turned on. Alternatively, a plurality of electric motors 32 may be utilized such that each motor rotates four or less of the axles 22. The drive assembly 30 may be powered by a power source 36 including one or more batteries or an electrical cord 38 may be provided which electrically couples the drive assembly 30 to a wall power outlet. The drive assembly 30 may be turned on or off with a conventional switch 40, though a pressure switch may be used which will actuate the drive assembly 30 when pressure from a person stepping onto the housing 12 is detected.

A vacuum 42 is mounted within the housing 12 and is in fluid communication with apertures 44 extending through the top wall. The apertures 44 may be positioned anywhere, however, it may be beneficial to disperse the apertures 44 between or under the brushes 20. The vacuum 42 is configured to suction material from the shoes into the housing 12. A container 46 is mounted within the housing 12 and is configured to retain the material suctioned by the vacuum 42. The container 46 is removable from the housing 12. A filter 48 may be mounted in the container 46 and/or housing 12 for allowing air to escape the container 46 and outwardly through an opening 50 in the perimeter wall 17.

In use, the housing 12 is positioned where appropriate such as adjacent to a doorway for a building. More particularly, the apparatus 10 may be best used adjacent to doorways of dwellings on a golf course. The apparatus 10 is turned on while a user stands on the foot cleaning assemblies 18. The foot cleaning assemblies 18 clean the bottoms and perimeter surfaces of the user's shoes to prevent the user from carrying debris, such as grass, dirt and the like, into a dwelling. The vacuum 42 pulls the debris into the housing 12 so that it may more easily be collected and discarded.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

The invention claimed is:

1. A shoe cleaning device comprising:

a housing having a top wall, a bottom wall and a perimeter wall being attached to and extending between said top and bottom walls;

a foot cleaning assembly being mounted to said housing and extending upwardly from said top wall, said foot cleaning assembly including a plurality of brushes being mounted in said top wall, said plurality of brushes each including a respective single axle and a respective plurality of bristles extending outwardly from said single axle, each of said brushes being rotatably coupled to said housing, said plurality of brushes being positioned in a pattern of a foot on said top wall, said plurality of brushes including a subset of interior brushes and a subset of perimeter brushes being disposed around said interior brushes, each of said interior brushes having said axle being horizontally oriented and being rotatable on a horizontal axis, each of said exterior brushes having said axle being vertically oriented and being rotatable on a vertical axis, wherein said exterior brushes are configured to clean an outer perimeter of a shoe while said interior brushes are cleaning a bottom of the shoe; and a drive assembly being mechanically coupled to said foot cleaning assembly and rotating said plurality of brushes when said drive assembly is turned on.

2. The shoe cleaning device according to claim 1, wherein said foot cleaning assembly has said plurality of brushes is positioned in a pattern of a right footed shoe or a pattern of a left footed shoe.

3. The shoe cleaning device according to claim 1, further including a vacuum being mounted within said housing and being in fluid communication with apertures extending through said top wall, said vacuum being configured to suction material from said shoes into said housing.

4. The shoe cleaning device according to claim 3, further including a container being mounted within said housing and being configured to retain the material suctioned by said vacuum, said container being removable from said housing.

5. A shoe cleaning device comprising:

a housing having a top wall, a bottom wall and a perimeter wall being attached to and extending between said top and bottom walls;

a pair of foot cleaning assemblies being mounted to said housing and extending upwardly from said top wall, each of said foot cleaning assemblies including a plurality of brushes being mounted in said top wall, said plurality of brushes each including an axle and plurality of bristles extending outwardly from an associated one of said axles, each of said brushes being rotatably coupled to said housing, said plurality of brushes being positioned in a pattern of a foot on said top wall, said plurality of brushes including a subset of interior brushes and a subset of perimeter brushes being disposed around said interior brushes, each of said interior brushes having said axle being horizontally oriented and being rotatable on a horizontal axis, each of said exterior brushes having said axle being vertically orientated and being rotatable on a vertical axis, wherein said exterior brushes are configured to clean an outer perimeter of a shoe while said interior brushes are cleaning a bottom of the shoe;

wherein one of said foot cleaning assemblies has said plurality of brushes being positioned in a pattern of a right footed shoe another of said foot cleaning assemblies has said plurality of brushes being positioned in a pattern of a left footed shoe;

a drive assembly being mechanically coupled to each of said foot cleaning assemblies and rotating said plurality of brushes when said drive assembly is turned on;

a vacuum being mounted within said housing and being in fluid communication with apertures extending through said top wall, said apertures alternating with said interior brushes along a length of each of said pattern of said right footed shoe and said pattern of said left footed shoe, said vacuum being configured to suction material from said shoes into said housing;

a container being mounted within said housing and being configured to retain the material suctioned by said vacuum, said container being removable from said housing.

* * * * *